US006619930B2

(12) United States Patent
Jansen et al.

(10) Patent No.: US 6,619,930 B2
(45) Date of Patent: Sep. 16, 2003

(54) METHOD AND APPARATUS FOR PRESSURIZING GAS

(75) Inventors: Keith Michael Jansen, Long Grove, IA (US); Kris Martin Jansen, Long Grove, IA (US)

(73) Assignee: Mandus Group, Ltd., Long Grove, IA (US)

( * ) Notice: Subject to any disclaimer, the term of this patent is extended or adjusted under 35 U.S.C. 154(b) by 3 days.

(21) Appl. No.: 09/835,989

(22) Filed: Apr. 17, 2001

(65) Prior Publication Data

US 2002/0150479 A1 Oct. 17, 2002

Related U.S. Application Data

(60) Provisional application No. 60/269,088, filed on Feb. 15, 2001, and provisional application No. 60/261,039, filed on Jan. 11, 2001.

(51) Int. Cl.[7] ..... F04B 9/08

(52) U.S. Cl. ..... 417/390; 417/44.2; 417/384

(58) Field of Search ..... 417/390, 199.1, 417/384, 44.2

(56) References Cited

U.S. PATENT DOCUMENTS

| | | | | | |
|---|---|---|---|---|---|
| 2,605,716 | A | * | 8/1952 | Huber | 417/390 |
| 2,973,694 | A | | 3/1961 | Herlach et al. | |
| 3,357,360 | A | * | 12/1967 | Borell | 417/390 |
| 3,941,508 | A | | 3/1976 | Worden | |
| 4,065,094 | A | * | 12/1977 | Adams | 60/404 |
| 4,371,318 | A | * | 2/1983 | Kime | 417/308 |
| 4,604,037 | A | * | 8/1986 | Hoya | 417/390 |
| 4,656,921 | A | | 4/1987 | Zierler | |
| 4,750,869 | A | * | 6/1988 | Shipman, III | 417/342 |
| 4,945,813 | A | | 8/1990 | Moscrip et al. | |
| 4,976,091 | A | * | 12/1990 | Salemka et al. | 53/467 |
| 5,105,922 | A | * | 4/1992 | Yant | 192/3.58 |
| 5,343,649 | A | | 9/1994 | Petrovich | |
| 5,387,089 | A | * | 2/1995 | Stogner et al. | 417/339 |
| 5,513,730 | A | | 5/1996 | Petrovich et al. | |

FOREIGN PATENT DOCUMENTS

| | | | | |
|---|---|---|---|---|
| JP | 56110588 A | * | 9/1981 | 417/390 |

* cited by examiner

*Primary Examiner*—Cheryl J. Tyler
(74) *Attorney, Agent, or Firm*—Brian J. Laurenzo; Michael C. Gilchrist; Jason M. Hunt

(57) ABSTRACT

A system and method for compressing gas uses a hydraulic pump and a hydraulic accumulator to compress gases in gaseous form. The accumulator is divided into a hydraulic chamber and a pneumatic chamber. The pneumatic chamber of the accumulator can be pneumatically connected to a gas supply and a gas receptacle that needs filled. One-way directional flow valves are used to permit the flow of gas from the gas supply to the pneumatic chamber and from the pneumatic chamber to the gas receptacle, but to prevent the flow of gas in the opposite direction. A motor drives the hydraulic pump, which moves pressurized oil into the hydraulic chamber of the accumulator. The pressurized oil within the hydraulic chamber of the accumulator compresses the gas within the pneumatic chamber of the accumulator, forcing the into a tank or other receptacle that needs filled. The invention can be used to compress a variety of gases at different flow rates, volumes, and pressures. The hydraulic pump can be driven by a single-phase or three-phase electric motor, or a gas or diesel powered motor.

7 Claims, 7 Drawing Sheets

METHOD AND APPARATUS FOR PRESSURIZING GAS

TECHNICAL FIELD

This invention relates generally to an intensifier for increasing the pressure in a gas supplied at a relatively low pressure at an input port and exhausted at an increased pressure at an output port. More specifically, the invention relates to an intensifier that utilizes a hydraulic pump to pressurize hydraulic fluid in a bladder-type accumulator to compress a gas within the bladder. A preferred use of the intensifier is to recharge nitrogen tanks on Howitzer guns that are known as equilibrators or recuperators.

BACKGROUND OF THE INVENTION

Many devices and processes use pressurized gas. One common method of supplying such pressurized gas is through the use of a tank that is filled with a pressurized gas. A valve on the tank permits the delivery of the gas at a high pressure to whatever device is driven by the gas. As the gas is eliminated from the tank, the pressure within the tank declines. After sufficient use, the pressure in the tank is so low that it does not provide gas at an optimal pressure. Eventually, the tank will need to be refilled, or replaced with a full tank. One common method of refilling the spent tanks is to attach them directly to a supply cylinder that is filled with pressurized gas. The pressure difference between the two containers causes gas to flow from the supply cylinder to the tank, eventually filling the tank to the required pressure.

A disadvantage of this method of filling spent tanks is that the tank cannot be filled to a pressure greater than the supply cylinder that it being used to fill it. As the supply cylinder is used, it loses pressure, and cannot be used to fill any spent tanks after its pressure drops to at or near the desired pressure of the tanks. Therefore, much of the gas in the supply cylinders is not utilized, and it is necessary to refill the supply cylinders even though they have pressurized gas remaining in them.

A known method for pressuring gas is the use of a piston and cylinder pump. While such devices are effective in pressurizing the gas, they are often susceptible to either contamination of the gas, or leakage of the gas, around the seals and gaskets that are necessary in such devices.

Therefore, there exists a need for a method and apparatus that permits filling of depleted tanks through the use of supply cylinders, even when the pressure in the supply cylinder is below the desired pressure of the tank. Preferably, the method and apparatus would be resistant to contamination or loss of the compressed gas around gaskets and seals.

SUMMARY OF THE INVENTION

The invention is directed to a gas compressor that uses a hydraulic pump and a hydraulic accumulator to compress gases in gas form. The accumulator is divided into a hydraulic chamber and a pneumatic chamber. The pneumatic chamber of the accumulator can be pneumatically connected to a gas supply and a gas receptacle that needs filled. One-way check valves are used to permit the flow of gas from the gas supply to the pneumatic chamber and from the pneumatic chamber to the gas receptacle, but to prevent the flow of gas in the opposite directions. A motor drives the hydraulic pump, which moves pressurized oil into the hydraulic chamber of the accumulator. The pressurized oil within the hydraulic chamber of the accumulator compresses the gas within the pneumatic chamber of the accumulator, forcing the gas into a tank or other receptacle that needs filled. The invention can be used to compress a variety of gases at different flow rates, volumes, and pressures. The hydraulic pump can be driven by a single-phase or three-phase electric motor, or a gas or diesel powered motor.

DETAILED DESCRIPTION OF THE PREFERRED EMBODIMENT

Figure 1:
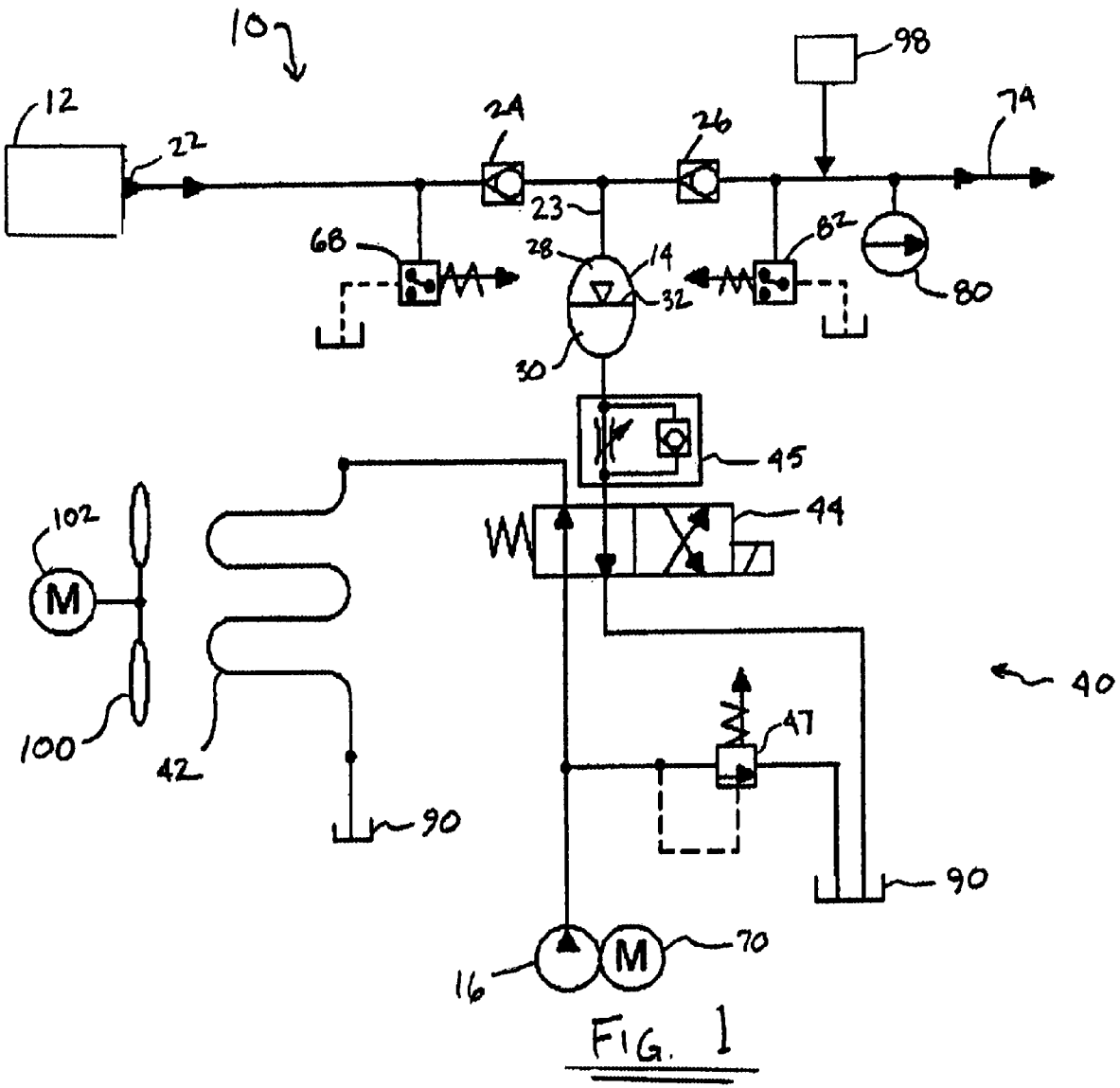
FIG. 1 is a schematic of the gas pressure intensifier system according to present invention.

Shown generally in the drawings is a preferred embodiment of a gas pressure intensifier system 10 according to the present invention. FIG. 1 shows a hydraulic/pneumatic schematic of the preferred intensifier system 10. The primary components of the system 10 are: a gas source 12, an accumulator 14 that receives gas from the source 12, a hydraulic pump 16 that is used to pressurize hydraulic fluid within the accumulator 14 and thereby pressurize the gas in the accumulator 14, and a gas receptacle 18 for receiving pressurized gas from the accumulator 14.

The gas source 12 is connected to a pneumatic input port 22. The pneumatic input port 22 is pneumatically connected to a first check valve 24. The first check valve 24 is a one way valve that permits gas to flow across the valve 24 from the gas source 12 towards the accumulator 14, but will not permit flow across the valve 24 back into the gas source 12. A second check valve 26 permits flow across the valve 26 through an output hose 74 into the receptacle 18, but prevents flow in the opposite direction. The accumulator 14 is pneumatically connected between the first and second check valves 24, 26.

Figure 2:
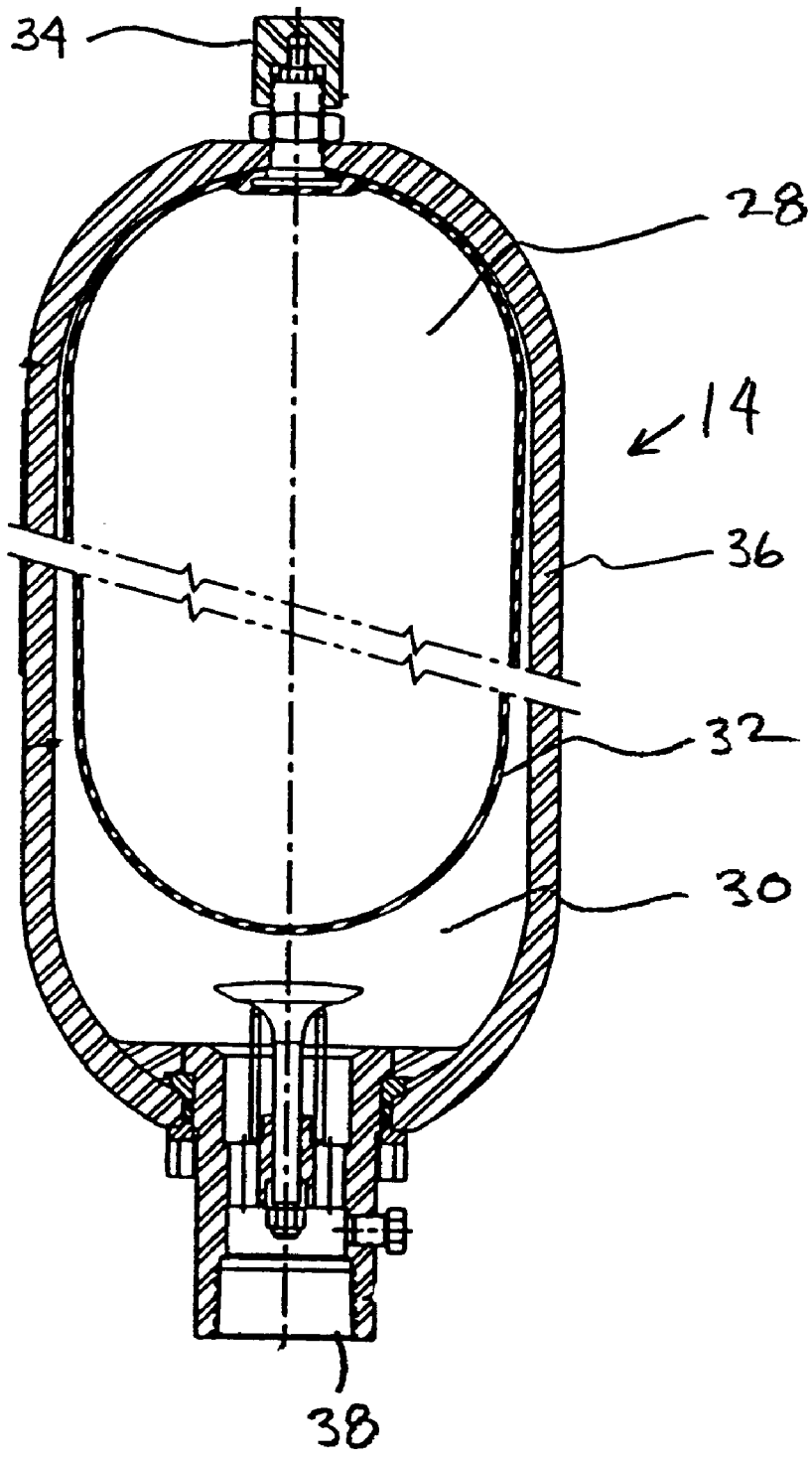
FIG. 2 is a cross-sectional detail view of a preferred embodiment of a bladder-type accumulator for use in the present invention.

The details of the accumulator 14 are best seen in FIG. 2. The accumulator is divided into a pneumatic chamber 28 and a hydraulic chamber 30. In the preferred embodiment, a flexible bladder 32 divides accumulator into the two chambers 28, 30. The pneumatic chamber 28 is formed by the inside of the bladder 32. A gas valve 34 connects the connector hose 23 with the pneumatic chamber 28 formed by the bladder 32. The flexible bladder 32 is contained within a hard shell 36. A fluid port 38 is provided at the end of the shell 36 opposite from the gas valve 34 to receive a supply of pressurized hydraulic fluid. The hydraulic chamber 30 is formed by the space between the outside of the bladder 32 and the inside of the shell 36. While a bladder-type accumulator is preferred, persons of ordinary skill in the art will understand that it may be possible to substitute a diaphragm or piston-type accumulator.

The fluid port 38 is connected to a hydraulic circuit 40 that controls the pressure of hydraulic fluid within the hydraulic chamber 30. The hydraulic circuit 40 includes the pump 16, a heat exchanger 42, a hydraulic control valve 44, and a pressure relief valve 47. The hydraulic control valve 44 is used to route the pressurized hydraulic fluid. When the control valve 44 is energized into an open position, the pressurized hydraulic fluid is routed into the hydraulic chamber 30 of the accumulator 14. When the control valve is in a closed position, the hydraulic fluid is routed across the heat exchanger 42 back to the hydraulic reservoir. When the control valve 44 is in the closed position, the hydraulic fluid within the hydraulic chamber 30 is permitted to drain to a hydraulic reservoir. The hydraulic control valve 44 can be cycled between the open and closed positions to periodically increase and decrease the pressure within the hydraulic chamber 30 when the pump 16 is running.

To use the intensifier system 10 described above, the gas source 12 is connected to the input port 22. The output hose 74 is connected to the receptacle 18. Typically, the gas source 12 will have a valve that needs to be opened to permit gas from the gas source to flow into the input hose 22. Once the gas source 12 is in connection with the input hose, and opened to permit flow into the input hose, the gas will flow across the first check valve 24 into the pneumatic chamber 28, until the pressure in the pneumatic chamber equalizes with the pressure in the gas source 12. The gas cannot flow back into the gas source because the first check valve 24 will not permit flow in that direction. If the pressure in the pneumatic chamber 28 is greater than the pressure in the gas receptacle 18, the gas will flow across the second check valve 26 into the gas receptacle 18 until the pressure in the pneumatic chamber 28 and the gas receptacle 18 are equalized.

With the system pneumatically connected as described in the immediately preceding paragraph is it possible to begin pumping pressurized gas into the gas receptacle 18. To begin this process the pump 16 is engaged to pressurize the hydraulic fluid within the hydraulic circuit 40. The pump 16 pushes the hydraulic fluid across the control valve 44. With the control valve in the open position, the pressurized hydraulic fluid flows into the hydraulic chamber 30 of the accumulator 14. When the pressure in the hydraulic chamber 30 becomes greater than the initial pressure in the pneumatic chamber 28, the pressure difference across the bladder 32 causes the bladder 32 to collapse within the accumulator 14, thereby compressing the gas within the pneumatic chamber 28. When the gas within the pneumatic chamber 28 is compressed to a pressure greater than the pressure within the gas receptacle 18, the gas will flow across the second check valve 26 and into the gas receptacle 18. The first check valve 24 prevents the gas from flowing back into the gas source 12. The hydraulic control valve 44 can then be cycled to the closed position, which diverts the pressurized hydraulic fluid from the pump 16 back to the reservoir 90 across a heat exchanger 42 to cool the hydraulic fluid. With the hydraulic control valve 44 in the closed position, the hydraulic fluid within the hydraulic chamber 30 of the accumulator 14 will drain back to the reservoir, thereby dropping the pressure within the accumulator 14. Once the pressure within the accumulator drops below the pressure within the gas source 12, gas will flow from the gas source 12 across the first check valve 24 to fill the pneumatic chamber 28 and collapse the hydraulic chamber 30. The hydraulic control valve 44 can then be moved back to the open position to repeat the cycle and pump the gas within the pneumatic chamber 28 into the gas receptacle 18. This process can be repeated until the gas receptacle 18 is filled to a desired pressure.

This is a unique and unintended use for the accumulator 14. The standard uses for accumulators are: to store power for intermittent duty cycles, to provide emergency or standby power, to compensate for leakage, to act as shock absorbers, or to dampen pulsations in a hydraulic system. Using the movement of the bladder 32 to compress a gas is a way of transforming the power of a hydraulic pump into a gas compressor.

Thus far what has been described is a generalized intensifier system 10 that is expected to have wide application in providing pressurized gas. A specific preferred embodiment of the intensifier system 10 has been developed that is adapted for use in charging nitrogen vessels, such as equilibrators or equalizers in artillery. Details of this preferred embodiment is shown in FIGS. 4–8.

Figure 4:
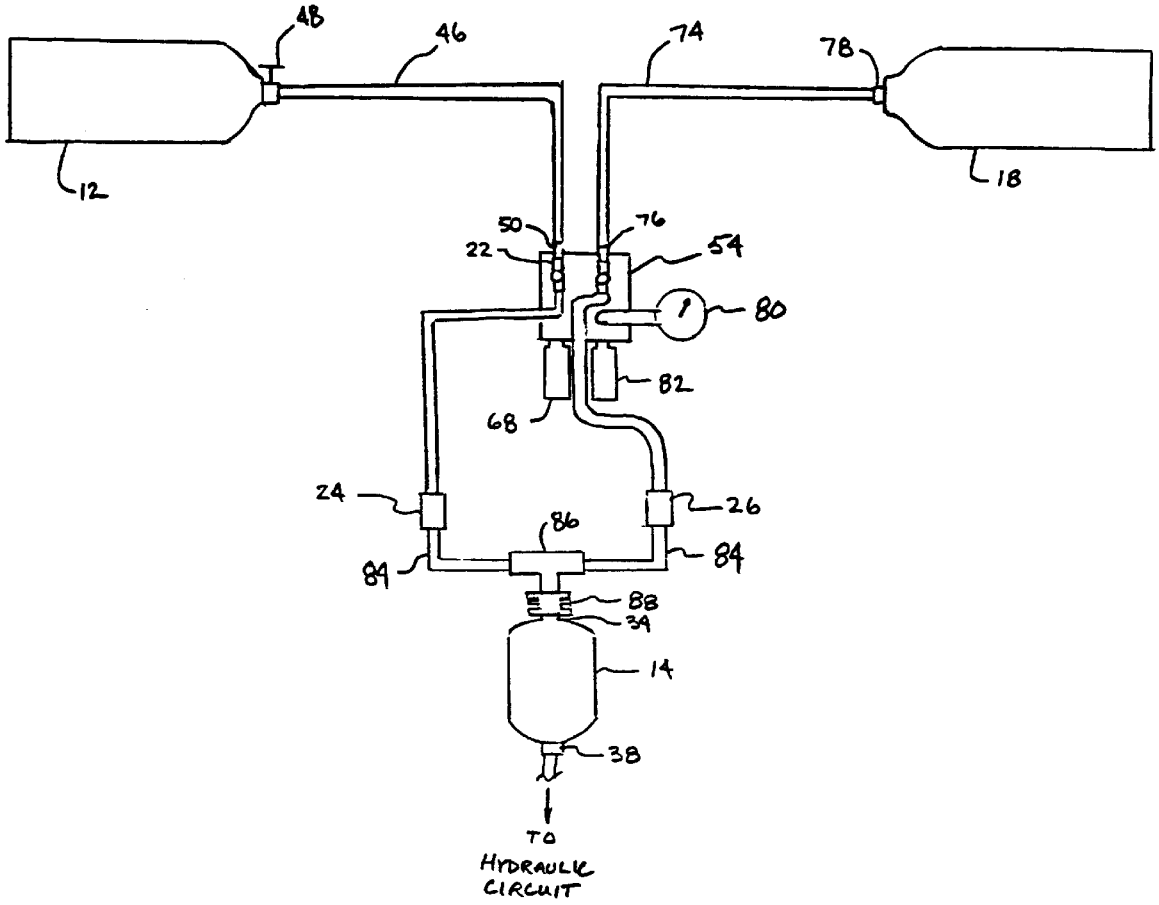
FIG. 4 is a representational view of a preferred embodiment of the pneumatic components of the present invention.
Figure 6A:
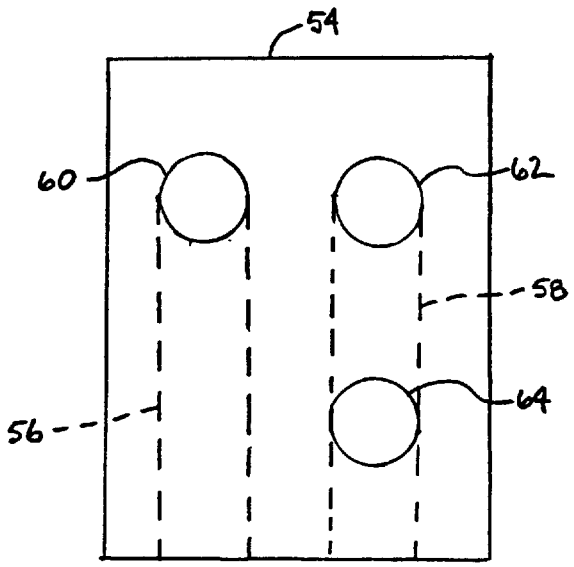
FIG. 6A is a top view of a preferred embodiment of a manifold used in the present invention.
Figure 6B:
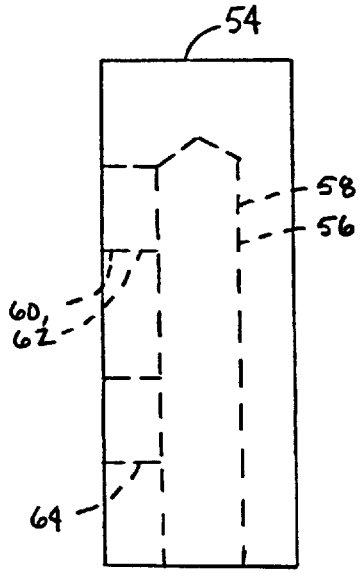
FIG. 6B is a side view of the manifold of FIG. 6A.
Figure 7:
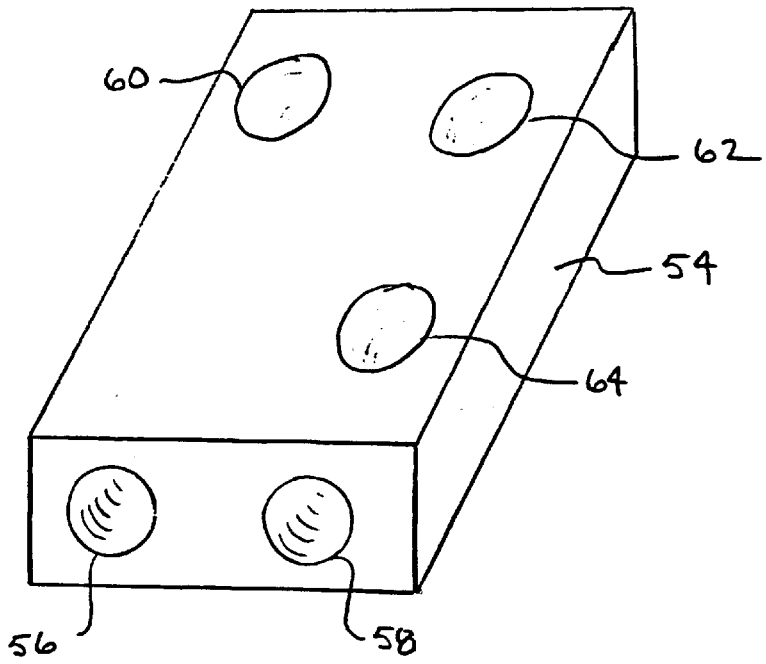
FIG. 7 is a perspective view of the manifold of FIG. 6A.
Figure 8:
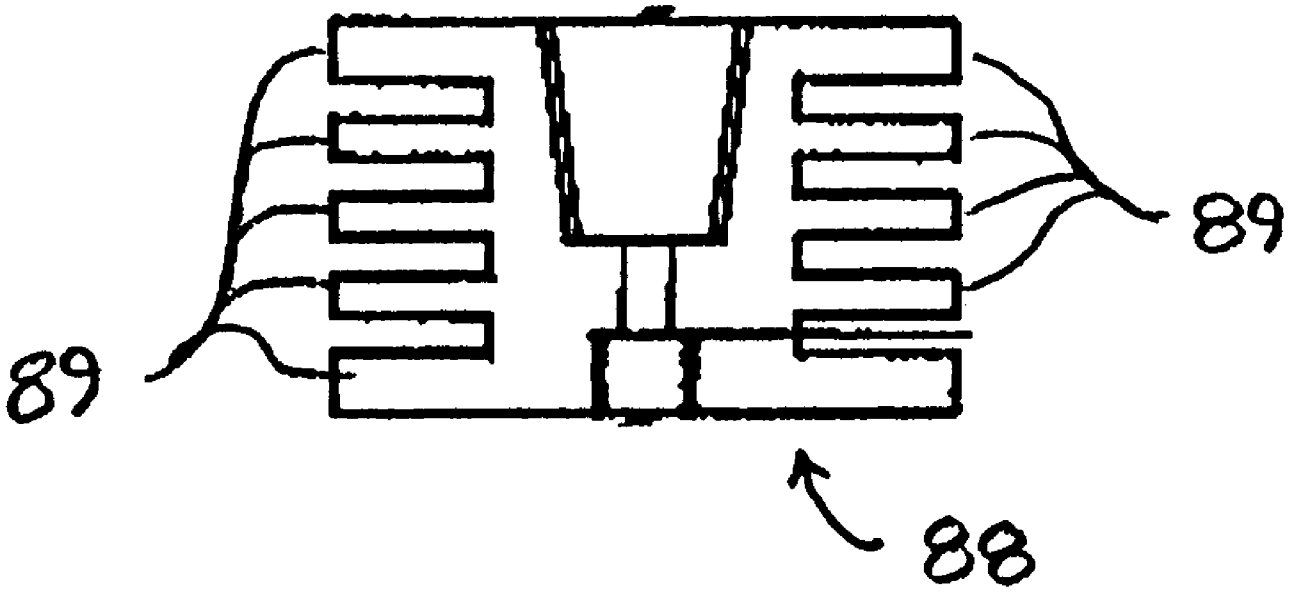
FIG. 8 is a cross-sectional detail of a preferred embodiment of a heat sink used in the present invention.

FIG. 4 shows the pneumatic portion of the pressure intensifier system 10 suited for use in filling nitrogen cylinders. A manifold 54 is used to direct the flow of gas. The manifold 54, shown in detail in FIGS. 6A, 6B, and 7 is in the shape of a rectilinear six-sided block. Preferably the manifold 54 is manufactured out of a hard, gas impermeable material such as 1018 steel. The manifold 54 is provided with two longitudinal bores—an input bore 56 and an output bore 58—that go most, but not all, of the way through the manifold 54. The input bore 56 is intersected near its terminus by a transverse bore 60. The output bore 58 is intersected by a pair of transverse bores 62, 64.

A T-connector is provided in sealed engagement with the transverse bore 60 that connects with the input bore 56. One of the free ends of the T-connector is provided with a female quick connect coupling for attachment to the gas source 12. The other free end of this T-connector is connected to an air hose that connects to the first check valve 24. The open end of the input bore 56 is connected to a low pressure switch 68. The low pressure switch 68 is electrically connected to a motor 70 that drives the hydraulic pump 16. The low pressure switch 68 is normally in an open position, and prevents the motor 70 from running unless it is closed. The low pressure switch 68 is moved to a closed position when the gas pressure within the input bore 56 is above a set minimum pressure. If the pressure within the input bore 56 drops below this set minimum pressure, the low pressure switch 68 opens and turns off the motor 70 to prevent damaging the motor 70 or pump 16 if the gas pressure in the gas source 12 is too low to be used. In the case of the preferred embodiment, the minimum useful pressure of the input gas is about 150 psi.

A male quick connect is pneumatically sealed with transverse bore 62 near the terminus of the output bore 58. This male quick connect is connectable to an output hose 74 that is equipped with a female quick connect 76 on one of its ends. A gas chuck 78 is provided at the other end of the output hose 74. The gas chuck 78 is adapted to fit a Schrader Valve that is commonly found on the nitrogen cylinders of Howitzer guns.

A T-connector is pneumatically sealed with transverse bore 64 that extends into the output bore 58. One of the free ends of this T-connector is attached to a pressure gauge 80 to monitor the pressure of gas within the output bore 58. The other free end of this T-connector is connected to an air hose that connects to the second check valve 26. The open end of the output bore 58 is connected to a high pressure switch 82.

The high pressure switch 82 is electrically connected to the motor 70 that drives the hydraulic pump 16. The high pressure switch 82 is normally in a closed position, and permits the motor 70 to run unless it is opened. The high pressure switch 68 is moved to an open position when the gas pressure within the input bore 60 is above a set maximum pressure. If the pressure within the input bore 60 raises above this set maximum pressure, the high pressure switch 82 opens and turns off the motor 70 to prevent damaging the system 10, or any harming people in close proximity to the system 10. In the case of the preferred embodiment, the maximum pressure is set at approximately 1990 psi.

A pair of elbows 84 connect each of the check valves 24, 26 to opposing ends of a T-connector 86. The third end of the T-connector 86 is engaged in a heat sink 88 that is used to dissipate heat from the compressed gas.

The heat sink 88 engages the gas valve 34 on the accumulator 14 to form a pneumatic connection between the check valves 24, 26 and the pneumatic chamber 28 of the accumulator 14. Details of the heat sink can be seen in FIG. 8. The preferred heat sink 88 is formed from a single piece of metal that has a high heat conductivity, and is provided with a series of fins 89 to increase the surface area of the heat sink 88.

The gas source 12 is in this case a nitrogen supply tank that includes a regulator line 46 with a regulator adjusting valve 48 to selectively open and close the regulator line 46. The regulator line 46 is provided with a male quick connect coupling 50 on its terminal end. The regulator line 46 can be attached to the pressure intensifier system 10 by connecting the male quick connect coupling 50 to the female quick connect coupling 66 attached to the input bore 56 of the manifold 54.

A nitrogen extraction kit 98 may be provided between the second check valve 26 and the gas receptacle 18. The nitrogen extraction kit 98 is used to allow the system to extract and purify nitrogen from the receptacle 18. This prevents the gas in the receptacle 18 from being wasted if it is necessary to bleed the pressure off the gas receptacle 18 for any reason such as cleaning.

Figure 5:
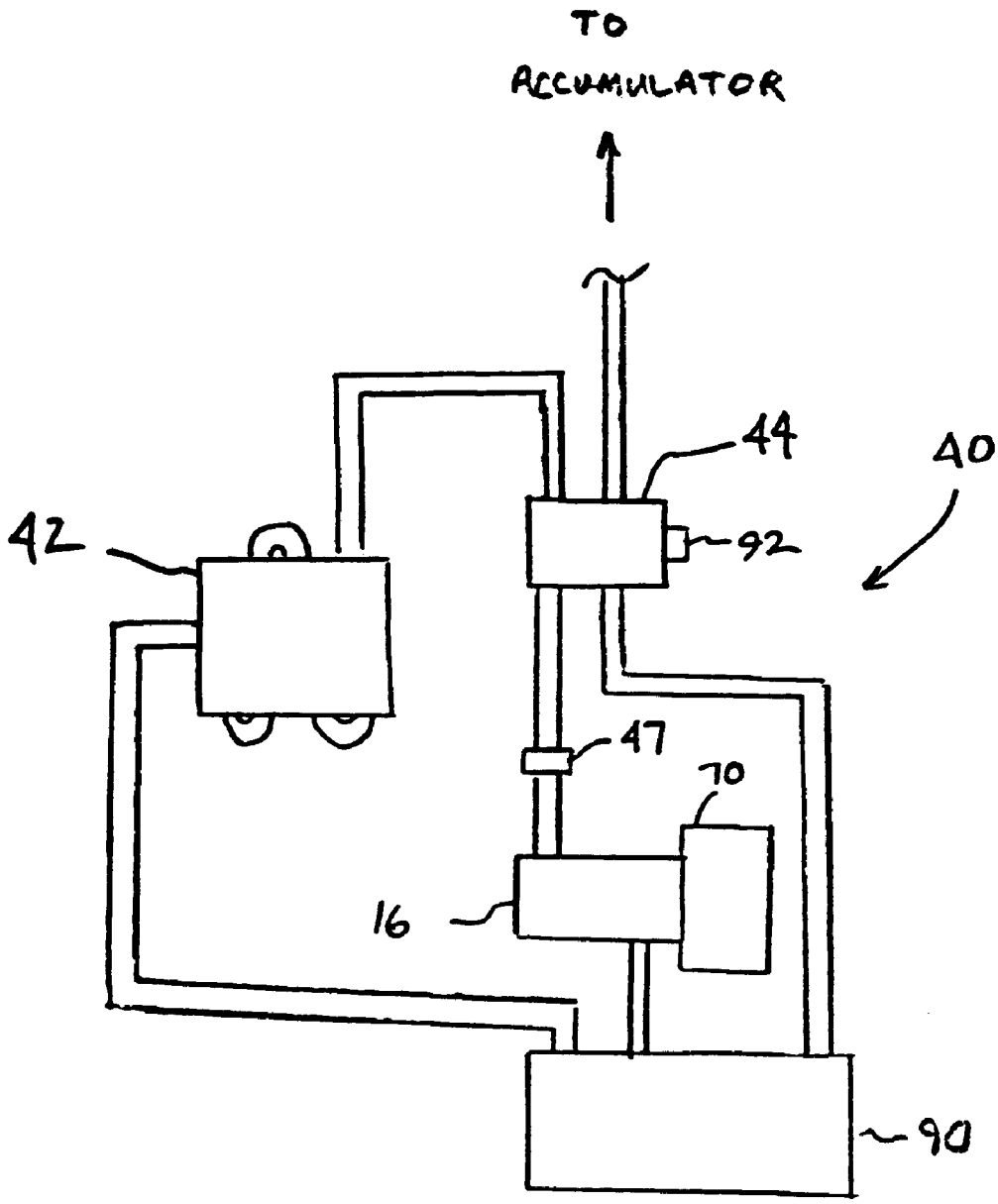
FIG. 5 is a representational view of a preferred embodiment of the hydraulic components of the present invention.

FIG. 5 shows the hydraulic circuit 40 of the preferred embodiment used to fill nitrogen cylinders. A hydraulic pump 16 is driven by an electric motor 70. In the preferred embodiment, the pump 16 and motor 70 are provided in a single unit. The motor is a 1.5 horsepower, 1725 rpm, single-phase electric motor. A variety of different motors would be acceptable, including three phase, gas, or diesel motors. The pump in the preferred embodiment will move approximately 1.2 gallons of hydraulic fluid per minute at 1725 rpm. It is rated to produce 2000 psi in continuous duty and up to 3000 psi intermittently. A pressure relief valve 47 is provided on the high pressure side of the pump 16 to prevent the pressure in the hydraulic lines from getting too high. In the preferred embodiment, this pressure relief valve 47 is set to open at pressures above approximately 2100 psi. Obviously, components of different specifications can be used depending on the volumes and pressures of gas that are needed.

The pump 16 pumps hydraulic fluid from the reservoir tank 90 into the hydraulic control valve 44. The hydraulic control valve 44 is a four-way two-position valve. The control valve 44 is adjusted by an electric solenoid within the control valve 44. When solenoid is energized, the control valve is adjusted into an open position that directs the hydraulic fluid into the accumulator 14. When the solenoid is not energized, the control valve 44 returns to its steady-state closed position. When the control valve 44 is in the closed position, the hydraulic fluid coming into the control valve 44 from the pump 16 is directed across the heat exchanger 42 back to the reservoir tank 90. The control valve 44 is provided with an adjustable needle valve 45 that permits any hydraulic fluid within the accumulator 14 to drain out of the accumulator and back to the reservoir tank 90. The adjustable needle valve 45 can be adjusted to control the rate of flow of hydraulic fluid from the accumulator to the reservoir tank 90.

The heat exchanger 42 may be equipped with a fan 100 to improve the heat dissipation of the heat exchanger 42. In the preferred embodiment, the fan 100 is driven by the same motor 70 that drives the pump 16. Alternatively, the fan 100 may be provided with its own electric motor 102.

The control valve 44 is provided with a timer 92 that cycles the solenoid on and off to adjust the position of the control valve 44. In the preferred embodiment, the timer is set such that the solenoid is repeatedly energized for ten seconds and then unenergized for eight seconds. Therefore, for ten seconds, while the control valve 44 is in the open position, the pump 16 pumps hydraulic fluid into the hydraulic chamber 30 of the accumulator 14. During this phase, the hydraulic fluid collapses the bladder 32 within the accumulator 14 to compress the gas within the pneumatic chamber 28. When the pressure in the gas in the pneumatic chamber 28 exceeds the pressure of the gas in the gas receptacle 18, gas will flow across the second check valve 26, and into the gas receptacle 18. Notice that the first check valve 24 prevents the gas from flowing back into the gas source 12. When the solenoid is not energized, the control valve 44 moves back to the closed position, the pressure within the hydraulic chamber 30 drops, and the hydraulic fluid is forced out of the accumulator 14 by the gas pressure expanding the bladder 32. As the gas expands to occupy the space evacuated by the draining hydraulic fluid, its pressure drops. When the pressure in the pneumatic chamber drops below the pressure of gas in the gas supply 12, gas flows from the gas source 12 across the first check valve 24 into the pneumatic chamber 28. The cycle is then repeated, until the desired pressure in the gas receptacle 18 is reached. The pressure within the gas receptacle 18 can be determined by viewing the pressure gauge 80. Persons of ordinary skill will understand the approximate times needed to cycle the control valve 44 between the open and closed positions to achieve the desired pressures. It will depend on the size of the accumulator, the power of the pump, the efficiency of the pump, the amount of gas contained in the lines between the components of the system, and other factors. It may be necessary to adjust the exact timing based on trial and error until a preferred timing is determined.

Persons of ordinary skill in the art will appreciate various ways of controlling the components of the system. It is preferred to have an on-off momentary switch to complete a circuit that electrically energizes the pump motor 70, the heat exchanger motor 102, and the timer 92 and solenoid of the control valve 44. The on-off momentary switch can then be used to start and stop the compressing process. The low and high pressure switches 68 & 82 are in line with the momentary switch to cut-off power to the pump motor 70, the heat exchanger motor 102, and the timer 92 and solenoid of the control valve 44 if the pressure in the gas source 12 gets too low or the pressure in the gas receptacle 18 reaches the set maximum level.

Figure 3:
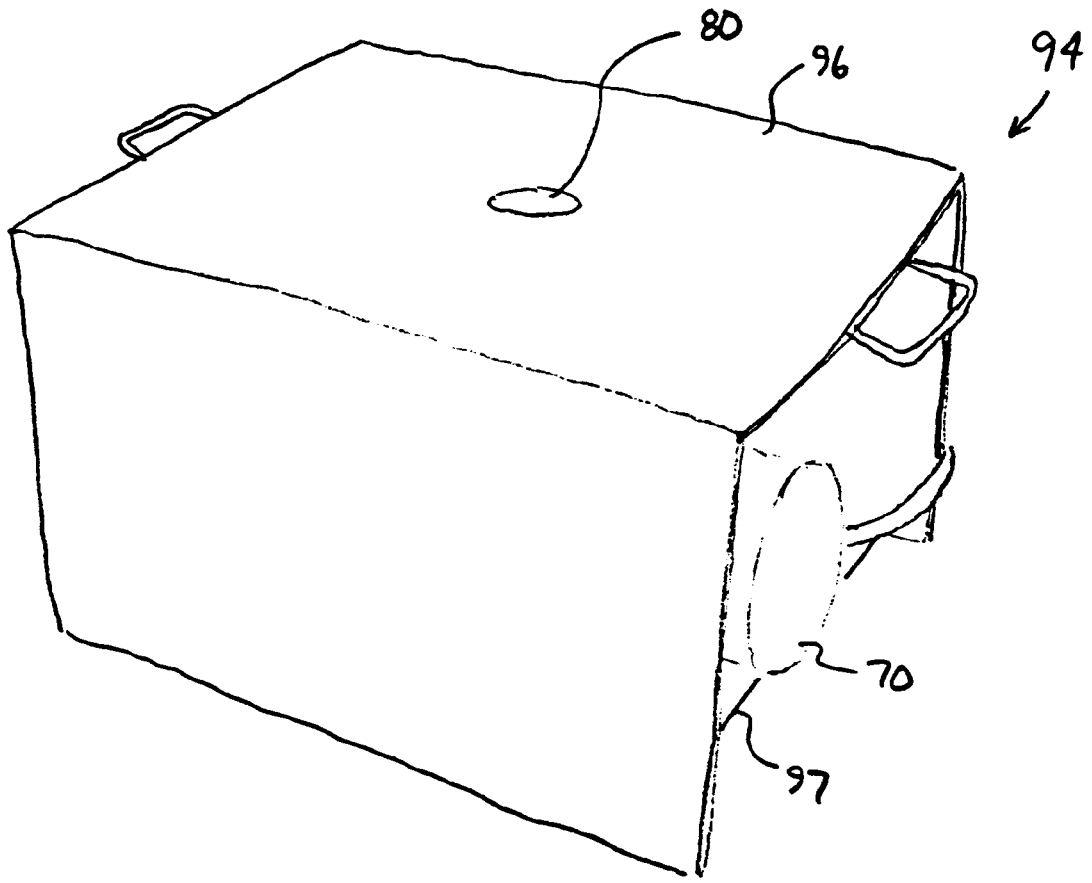
FIG. 3 is a perspective view of a preferred unit embodying the gas pressure intensifier system according the present invention.

As seen in FIG. 3, the components of the gas pressure intensifier system may be combined in a single portable unit 94. To accomplish this, the components are mounted to a frame 97, and then protected by a cover 96. Preferably the cover 96 is provided with an opening to allow for inspection of the pressure gauge 80. In the preferred embodiment, the frame and cover 96 are made of steel. Persons of ordinary skill in the art will be aware of numerous arrangements for the components of the system 10.

To operate the specific embodiment described above, an operator should first add hydraulic fluid to the reservoir 90. In the preferred embodiment 3.75 quarts of oil are used as the hydraulic fluid, specifically, the preferred hydraulic fluid is (MIL-PRF-6083F). Those of ordinary skill in the art will be aware of alternative hydraulic fluids. After adding the hydraulic fluid to the reservoir (or verifying that it is still at an appropriate level after the first use), the gas chuck 78 of the output hose 74 should be attached to the gas receptacle 18 that is being filled. Typically, the gas receptacle will have a Schrader Valve for the gas chuck 78 to attach to. Next, the male quick connect 50 from the regulator line 46 of the supply tank 12 is attached to the female quick connect 66 that is connected to the input bore 56 of the manifold 54. The Schrader Valve on the gas receptacle 18 can then be adjusted to an open position. The regulator adjusting valve 48 on the supply tank 12 should then be slowly opened to let gas from the supply tank 12 flow into the system 10. If the pressure in the supply tank 12 is greater than the pressure in the gas receptacle 18, then the operator should wait a few moments until the pressure in the tanks 12 & 18 equilibrates. The momentary switch can then be turned on to energize the pump motor 70, the heat exchanger fan motor 102, and the control valve 44 and timer 92. The pump 16 will then begin to pump hydraulic fluid through the hydraulic circuit 40, and the system 10 will operate as described above. The pressure in the gas receptacle can be monitor by observing the pressure gauge 80. When the pressure reaches the desired level, the momentary switch should be moved to the off position to shut off all of the electrical components of the system 10. The Schrader Valve on the gas receptacle and the adjustable valve 48 on the supply tank 12 should then be closed. The pressure in the pneumatic lines should be slowly bled off by cracking the fitting on the gas chuck 78 attached to the gas receptacle 18. The operator should verify that the pressure has been released by checking that the pressure gauge 80 shows 0 (zero) psi. After it has been verified that the pressure in the pneumatic lines has been released, the output line 74 can be removed from the gas receptacle 18. The gas chuck 78 can then be attached to another gas receptacle 18 that needs to be filled an the process can be repeated. If no more gas receptacles need filling, then the regulator line 46 of the supply tank 12 can be removed from the input port 22.

Thus, it can be seen that the above-described invention provides a method and apparatus that permits filling of depleted receptacle tanks through the use of supply cylinders, even when the pressure in the supply cylinder is below the desired pressure of the tank. It should be understood that the foregoing description relates to a preferred embodiment of the invention. Modifications and deviations from this preferred embodiment will be obvious to those of skill in the art without departing from the invention. For example, while most of the discussion has focused on using the intensifier system 10 to fill rechargeable receptacle tanks, the system 10 could be used to provide compressed gas for nearly any purpose.

We claim:

1. A method of filling a gas receptacle to a desired pressure, the method comprising:

providing an accumulator, said accumulator having a pneumatic chamber and a hydraulic chamber;

providing a gas receptacle;

providing a gas supply;

pneumatically connecting said gas supply to said pneumatic chamber of said accumulator such that gas can flow from said gas supply to said pneumatic chamber but cannot flow from said pneumatic chamber to said gas supply;

pneumatically connecting said gas receptacle to said pneumatic chamber of said accumulator such that gas can flow from said pneumatic chamber to said gas receptacle but cannot flow from said gas receptacle to said pneumatic chamber;

permitting a portion of gas to flow from said gas supply to said pneumatic chamber at an initial pressure;

pressurizing hydraulic fluid within said hydraulic chamber to thereby compress and pressurize said portion of gas within said pneumatic chamber to an elevated pressure, thereby causing at least some of said portion of gas to flow into said gas receptacle;

repeating said permitting and pressurizing steps until the pressure in said gas receptacle reaches the desired pressure; and providing a low pressure switch which will terminate said pressurizing step if said initial pressure of said portion of gas is below a specified minimum pressure.

2. The method according to claim 1, wherein said accumulator is a bladder-type accumulator, wherein said bladder-type accumulator has a bladder having an inside and an outside, and wherein said inside of said bladder forms said pneumatic chamber.

3. The method according to claim 1, further comprising providing a hydraulic circuit including a pressure relief valve and a hydraulic pump, said hydraulic circuit connecting said hydraulic pump with said hydraulic chamber of said accumulator.

4. The method according to claim 3, wherein said hydraulic circuit further comprises a two-position valve, said two-position valve for directing hydraulic fluid to said hydraulic chamber when said two-position valve is in a pressurizing position, said two-position valve permitting said hydraulic fluid to drain out of said hydraulic chamber when said two-position valve is in a draining position.

5. The method according to claim 4, wherein said hydraulic circuit includes a heat exchanger between said two-position valve a said drain reservoir.

6. The method according to claim 1, further comprising providing a high pressure switch which will terminate said pressurizing step if said elevated pressure is greater than a maximum pressure.

7. The method according to claim 1, wherein said repeating step is initiated by a timer.

* * * * *